US006513314B2

(12) United States Patent
Cook

(10) Patent No.: US 6,513,314 B2
(45) Date of Patent: Feb. 4, 2003

(54) APPARATUS AND METHOD OF MANUFACTURING MULTI-FILAMENT CORDS

(75) Inventor: Ricky A. Cook, Scottsboro, AL (US)

(73) Assignee: Acordis Industrial Fibers, Inc., Scottsboro, AL (US)

( * ) Notice: Subject to any disclaimer, the term of this patent is extended or adjusted under 35 U.S.C. 154(b) by 0 days.

(21) Appl. No.: 09/880,903

(22) Filed: Jun. 15, 2001

(65) Prior Publication Data

US 2002/0189228 A1 Dec. 19, 2002

(51) Int. Cl.[7] ..... D01H 7/86
(52) U.S. Cl. ..... 57/58.36; 57/352
(58) Field of Search ..... 57/58.32, 58.34, 57/58.36, 58.38, 58.49, 58.52, 58.65, 58.7, 58.83, 352

(56) References Cited

U.S. PATENT DOCUMENTS

| | | | | |
|---|---|---|---|---|
| 3,661,668 A | | 5/1972 | Gallagher | |
| 3,969,884 A | | 7/1976 | Inohara et al. | |
| 4,163,357 A | * | 8/1979 | Greive et al. | 57/58.36 |
| 4,495,759 A | | 1/1985 | Brandyberry et al. | |
| 4,720,943 A | | 1/1988 | Arrant | |
| 4,887,421 A | | 12/1989 | Haislet | |
| 4,894,982 A | * | 1/1990 | Bianchi | 57/58.36 |
| 4,932,198 A | * | 6/1990 | Eisenhauer et al. | 57/58.36 |
| 6,098,392 A | | 8/2000 | Tung | |

FOREIGN PATENT DOCUMENTS

EP 0313877 A1 * 5/1989

OTHER PUBLICATIONS

H. Weisser; M. Czapay: "Reifencordzwirne produzieren nach dem Cablierverfahren" Kunststoffberater, vol. 37, No. 1/2, Jan. 1992–Feb. 1992, pp. 38–40, 43.

* cited by examiner

*Primary Examiner*—John J. Calvert
*Assistant Examiner*—Shaun R Hurley
(74) *Attorney, Agent, or Firm*—Oliff & Berridge, PLC

(57) ABSTRACT

The invention includes a first bobbin that supplies a first yarn, a second bobbin that supplies a second yarn, and a third bobbin that supplies a third yarn. Additionally, the invention includes a guide that guides the first and second yarns so that they are substantially parallel to each other, and a combining device the combines and twists the parallel disposed first and second yarns with the third yarn. The invention enables the manufacture of a two-ply cord having a filler yarn therein, in a single step, and also allows more cord to be manufactured within a specified time period.

10 Claims, 2 Drawing Sheets

APPARATUS AND METHOD OF MANUFACTURING MULTI-FILAMENT CORDS

BACKGROUND OF THE INVENTION

1. Field of Invention

The invention concerns an apparatus and a method for manufacturing cords which are incorporated into automobile tires, conveyor belts, hoses, and similar structures. More particularly, the invention relates to a cabling machine that performs a one-step process for making a two-ply cord with a filler yam therein, also known as gas adsorption fiber, and a method of operating such a cabling machine.

2. Description of Related Art

Two-ply cords are used to reinforce manufactured products, such as automobile tires, conveyor belts, hoses and similar products. For example, in the case of tire manufacturing, two-ply cords are sandwiched between two layers of rubber. However, undesirable gas bubbles form between the rubber layers during the sandwiching process. Because gas adsorption yarn prevents gas bubble development, it is typically combined with the two-ply cord.

Manufacturing cords intended for use in tire manufacturing typically involves twisting two continuous filament yarns to form a two-ply cord. As indicated above, it is often desirable to include an additional staple fiber gas adsorption yarn in the two-ply cord, for example a rayon yam, to inhibit gas bubble development. Typically, these cords have been made in two steps, the first step forms a one-ply cord by twisting one continuous filament yarn. The second step twists two one-ply cords, each formed in the first step, with a gas adsorption yarn to form a three-ply cord.

The first step involves twisting one continuous filament yam clockwise into a one-ply cord and winding the one-ply cord onto a take-up bobbin using a first ring twisting machine. Twisting the yam clockwise is also known as forming a Z-twist.

The second step involves removing the one-ply cord on a bobbin from the first ring twisting machine and installing it as a two-ply cord feed bobbin on a second cabling machine. A second feed bobbin supplying gas adsorption yam is also installed on the second cabling machine. The two-ply cord is twisted counter-clockwise with the gas adsorption yarn to form a three ply gas adsorption cord. Twisting in the counter-clockwise direction is also known as forming an S-twist.

The above related art two step twisting process increases manufacturing costs. For example, because the first ring twisting machine must be turned off and the take-up bobbin removed and installed in the second cabling machine, the time required for manufacturing increases, adding significantly to the cost of manufacturing.

Additionally, the step of moving bobbins between machines increases the risk of worker injury, effecting workplace safety.

Other methods for twisting fibers to form cords are known, such as that disclosed in U.S. Pat. No. 4,720,943 to Arrant (hereinafter "Arrant"). Arrant discloses a cord having a core that includes a single yarn or a plurality of parallel yarns laid side by side, wherein each yarn of the cord is drawn, oriented and is formed of continuous filaments of a synthetic polymer, and a wrapper yarn wound helically around the core yarn or yarns, and forming helices along the length of the core which hold the core yarns together.

Winding of the wrapper around the core tends to provide a core having a circular shaped cross section. However, Arrant does not disclose twisting all of the yarns together.

U.S. Pat. No. 4,887,421 to Haislet discloses a method and apparatus for forming in a single step operation a multiple filament cord of multiple layers which is free of strands within the cord and which the cord has all the filaments twisted in the direction of the lay of the cord. This method applies a twist of the filaments in the outer layers of the cord in a direction opposite from that to be applied to all the filaments in the cord. However, Haislet does not disclose twisting yarns together to form a gas adsorption cord. Thus, Arrant and Haislet do not solve the problems of the related art.

SUMMARY OF THE INVENTION

The invention involves a cabling machine for manufacturing multi-filament cords and includes a first bobbin supplying a first gas adsorption yarn, a second bobbin supplying a second yarn, and a third bobbin supplying a third yarn. A guide is provided at the end of an arm and guides the first gas adsorption yarn and the second yarn so they are substantially parallel to each other. Additionally, a combining device is provided for combining and twisting all three of the yarns so a two-ply cord having a continuous filament gas adsorption yarn can be formed.

The arm is connected to a bracket which has first and second bracket ends and a hole disposed near the first end. The bracket is in turn connected to a cone holder also having first and second ends, a taper between the ends, a circular cross section, and a partially threaded rod. The threaded rod is inserted through the bracket hole and a bolt is placed on the threads to secure the bracket and cone holder together.

The cone holder is oriented so that it is parallel and offset from the arm. A second guide is also connected to the arm.

The invention also relates to a method for manufacturing a multi-filament fiber in a single step and includes supplying a first gas adsorption yarn, a second yarn, and a third yarn. The method involves guiding the first gas adsorption yarn and the second yarn so they are substantially parallel to each other and then combining and twisting all three yarns to form a two-ply cord having a continuous filament gas adsorption yarn.

The method also includes attaching a bracket, having a hole, to an arm, and connecting a cone holder to the bracket by placing a bolt upon the threaded end of a rod extending from the cone holder. Another guide having a loop is attached to the arm.

It is therefore an object of this invention to reduce the manufacturing time and associated cost for producing the two-ply cord with a continuous filament gas adsorption yarn.

Another object of the invention is to improve workplace safety by eliminating bobbin handling between machines.

These and other features and advantages of this invention are described in or are apparent from the following detailed description of various exemplary embodiments of the systems and methods according to this invention.

BRIEF DESCRIPTION OF THE DRAWING

Various exemplary embodiments of systems and methods according to this invention will be described in detail, with reference to the following figures, wherein.

DETAILED DESCRIPTION OF PREFERRED EMBODIMENTS

Figure 1:
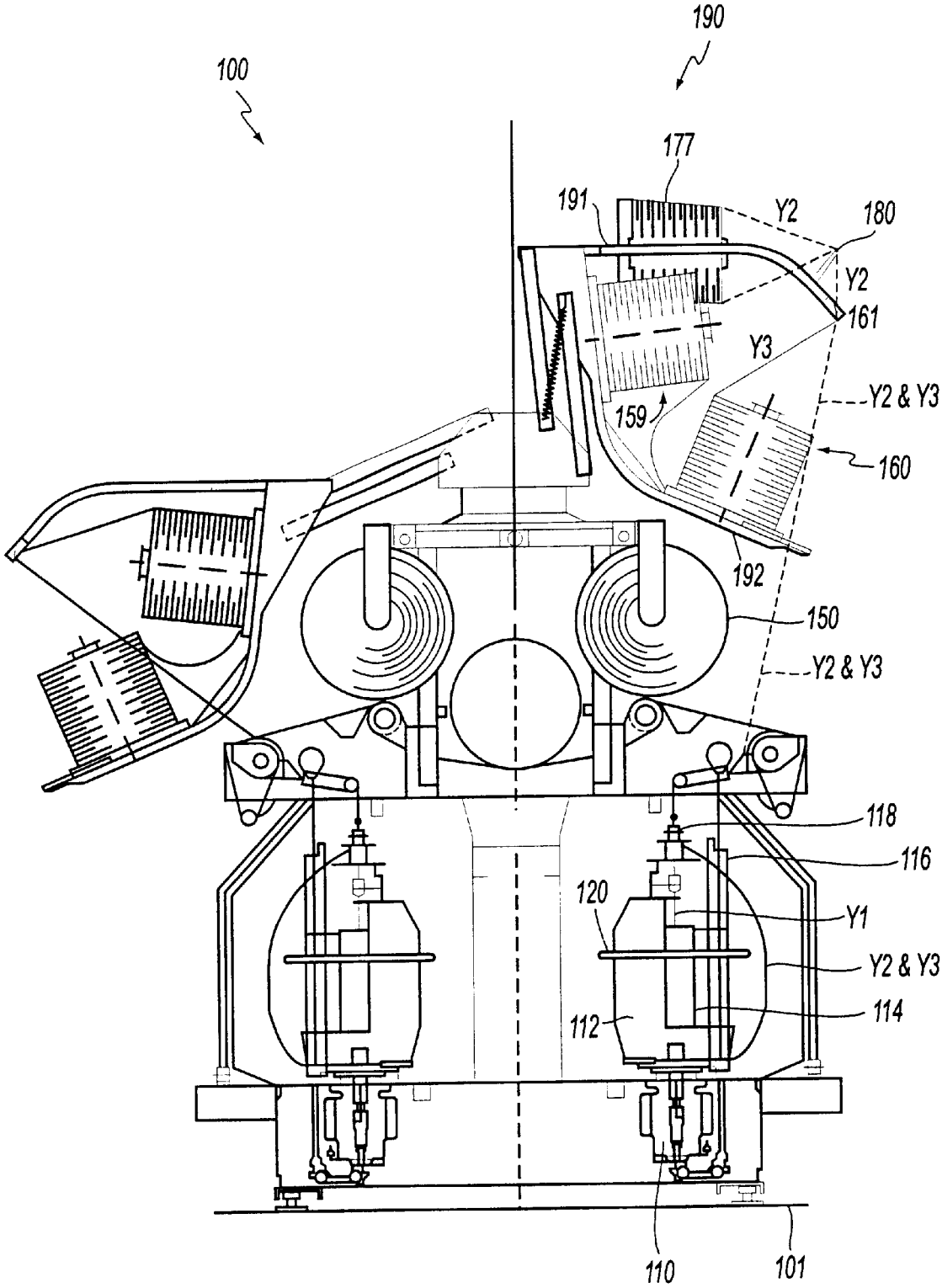
FIG. 1 shows a cabling machine incorporating a third feed bobbin in accordance with the invention.

The invention provides a one-step process for manufacturing a two-ply cord with a continuous filament gas adsorption yarn. FIG. 1 shows a cabling machine 100 used to manufacture two-ply cord in accordance with the invention. Cabling machine 100 has a spindle motor 110. A stationary bobbin container 112 is oriented above spindle motor 110 and contains a first feed bobbin 114. The first feed bobbin 114 contains continuous filament yarn Y1. Yarn Y1 is a continuous filament fiber and may be at least one of several yarn types, including rayon, nylon, polyester, and other similar materials.

Balloon ring 120 wraps around stationary bobbin container 112 and controls the thread balloon. Thread combining device 118 is located above the stationary bobbin container 112 and physically twists and combines the continuous filament yarns into a two-ply cord. A series of guides and pulleys are located above the thread combining device 118 and below the take-up bobbin 150. At the top of the cabling machine 100 is a mounting 190 having arms 191 and 192 for supporting feed bobbins 159 or 160. Arms 190 and 191 may have circular cross sections or any cross section suitable to support the bobbins.

As shown in FIG. 1, a third feed bobbin 177 is attached to arm 191. More particularly, as shown in FIGS. 2 and 3, a cone holder 170, also known as an adaptor, is connected to a bracket 173, which is in turn connected to cabling machine arm 191.

Cone holder 170 preferably has a circular cross section and tapers from a first end 171 to a second end 172. The circular cross section at the first end 171 is less than the circular cross section at the second end 172. A partially threaded rod 178, having a flange 179 located between the threads and second end 172, extends away from the second end 172. Cone holder 170 may be manufactured from any material capable of supporting a bobbin, including plastic, metal, and other material.

Figure 4:
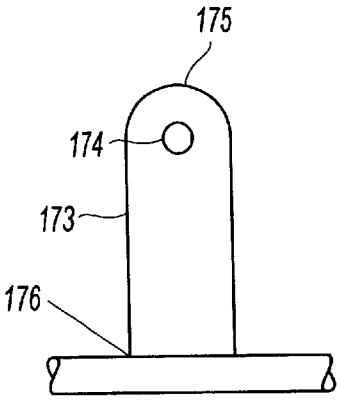
FIG. 4 is a blown-up plan view of the bracket in accordance with the invention.

Bracket 173, as shown in FIG. 4, connects cone holder 170 to the cabling machine arm 191. Bracket 173 may be made from any material capable of supporting the cone holder 170 and applied loads, including plastic, metal, and the like. Additionally, bracket 173 preferably has rectangular cross section as shown in FIGS. 2 and 3, but may have any cross section capable of supporting the cone holder 170 and applied loads. Hole 174 should be located towards a first end 175 of bracket 173 so that a minimum offset distance D is provided. Distance D preferably is about a foot, and should exceed the largest radius of the third bobbin 177. The second end 176 of bracket 173 is fixed to cabling machine arm 191. The second end 176 may be fixed to arm 191 using any suitable method, including but not limited to welding and using mechanical fasteners.

Figure 3:
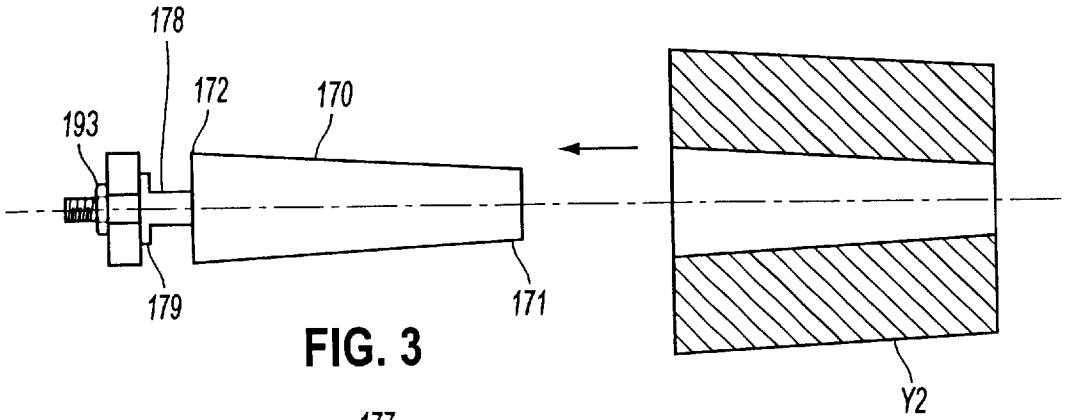
FIG. 3 is a side plan view of a cone holder and a cone being slid onto the cone holder in accordance with the invention.
Figure 2:
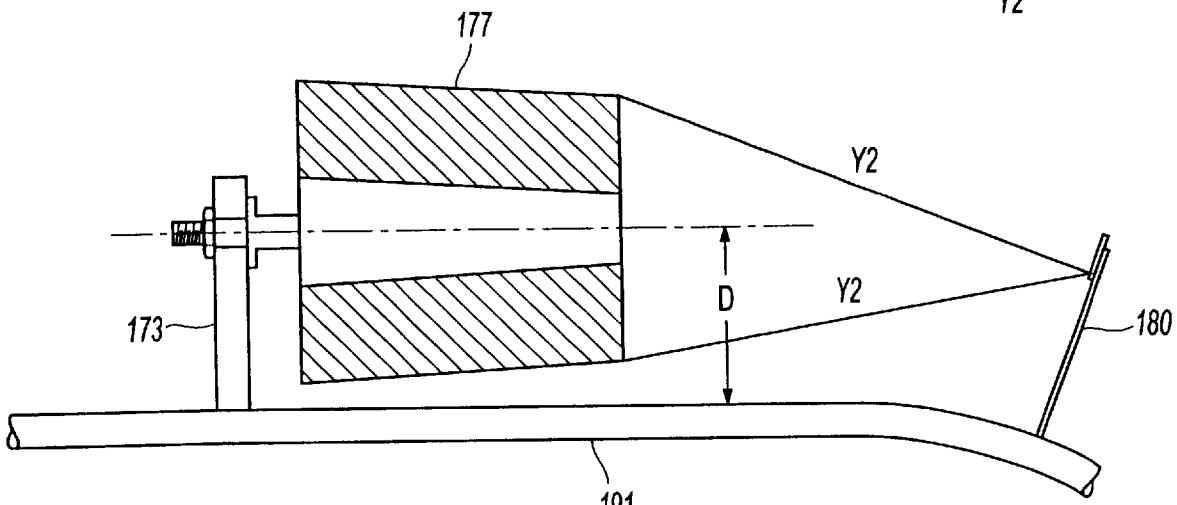
FIG. 2 is a top plan view of the third feed bobbin and bracket in accordance with the invention.

As shown in FIGS. 2 and 3, cone holder 170 is preferably fixed to bracket 173 using bolt 193. The partially threaded rod 178 is inserted into hole 174 so that flange 179 is flush with a surface of bracket 173. Bolt 193 is screwed onto the threads of rod 178 so that cone holder 170 and bracket 173 are securely connected.

Figure 5:
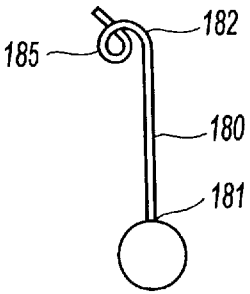
FIG. 5 is a blown-up plan view of the guide attached to a cabling machine arm in accordance with the invention.

FIGS. 2 and 5 show a guide 180 that guides continuous filament gas adsorption yarn Y2 from third bobbin 177 to guide 161. Guide 180 may be any kind of guiding device suitable for this purpose. FIGS. 2 and 5 show a guide 180 having a shape commonly known as a pigtail. It has a first end 181 connected to cabling machine arm 191 using a welded connection or a mechanical fastener connection. The second end 182 of guide 180 has a twisted configuration forming a loop 185 overlapping itself, while maintaining a space at the overlap. Loop 185 facilitates easy insertion of gas adsorption yarn Y2 into the loop 185.

The manufacturing operation using the cabling machine 100 as illustrated in FIG. 1, incorporating the above described structure, will now be described.

Continuous filament gas adsorption yarn Y2 is fed off of third bobbin 177 through loop 185 of guide 180. From guide 180, gas adsorption yarn Y2 passes to guide 161. At guide 161, gas adsorption yarn Y2 encounters yarn Y3 which feeds off of second feed bobbin 159 or 160. Yarn Y3 is also a continuous filament fiber and may be one of several yarn types, including rayon, nylon, polyester, and the like. At guide 161, yarns Y3 and Y2 are forced together so that they remain parallel to each other as they move from guide 161 to thread combining device 118. Yarns Y2 and Y3 continue parallel through guide tube 116, pass through spindle motor 110, exit radially from spindle motor 110, and are then passed to thread combining device 118. Yarns Y2 and Y3 maintain their parallel orientation during rotation about the stationary bobbin container 112 so that they rotate to form a thread balloon. Detrimental effects are not created by rotating yarns Y2 and Y3 about the stationary bobbin container 112 to form a thread balloon.

Stationary bobbin container 112 contains a first feed bobbin 114. First feed bobbin 114 contains continuous filament yarn Y1. Continuous filament yarn Y1 is fed from first feed bobbin 114 to thread combining device 118. Thread combining device 118 twists continuous filament yarns Y1 and Y3 with gas adsorption yarn Y2 to form a three-ply cord. After passing through thread combining device 118, the three-ply cord is guided through a series of guides and pulleys, and is wound upon take-up bobbin 150.

Thus, the third feed bobbin 177 enables the manufacture of a two-ply cord having an absorption yarn therein, also known as a gas absorption fiber, in a single step.

Another advantage of the single step process is that it enhances workplace safety by reducing manual handling of the bobbins.

The invention also allows more cord to be manufactured within a specified time period.

While the systems and methods of this invention have been described in conjunction with the specific embodiments outlined above, it is evident that many alternatives, modifications and variations will be apparent to those skilled in the art. Accordingly, the exemplary embodiments of the systems and methods of this invention, as set forth above, are intended to be illustrative, not limiting. Various changes may be made without departing from the spirit and scope of the invention.

What is claimed is:

1. A cabling machine for manufacturing multi-filament cords, comprising:

a first bobbin that supplies a first yarn;

a second bobbin that supplies a second yarn;

a guide that guides the first and second yarns into being substantially parallel with respect to each other;

a third bobbin that supplies a third yarn; and a combining device that combines and twists the parallel disposed first and second yarns with the third yarn.

2. The cabling machine as claimed in claim 1, said guide further comprising:

an arm, said guide being disposed at an end of said arm.

3. The cabling machine as claimed in claim 2, the arm further comprising a cone holder having a first end and a second end, the cone holder being tapered between said first and second ends, the cone holder having a circular cross section and a partially threaded rod extending away from said second end; and a bracket having a first bracket end and a second bracket end, the bracket defining a hole disposed at said first bracket end, said bracket second end being fixed to said arm;

wherein said partially threaded rod projects through said hole and a bolt is screwed onto said partially threaded rod to secure said cone holder to said bracket.

4. The cabling machine as claimed in claim 3, wherein said cone holder is parallel to and offset from said arm.

5. The cabling machine as claimed in claim 2, said arm further comprising:

a second guide having a first guide end, a second guide end and a twisted configuration forming a loop about said second end.

6. A method for manufacturing a multi-filament fiber, comprising:

supplying a first yarn;

supplying a second yarn;

guiding the first and second yarns into being substantially parallel with respect to each other;

supplying a third yarn; and combining and twisting the parallel disposed first and second yarns with the third yarn.

7. The method for manufacturing a multi-filament fiber as claimed in claim 6, further comprising:

providing a guide having an arm and said guide being disposed at an end of said arm.

8. The method for manufacturing a multi-filament fiber as claimed in claim 7, further comprising:

attaching a bracket to said arm, said bracket having a first bracket end and a second bracket end and a hole disposed at said first end, said second bracket end being attached to said arm;

attaching a cone holder to said bracket, said cone holder having a first end and a second end, the cone holder being tapered between said first and second ends, the cone holder having a circular cross section and a partially threaded rod extending away from said second end; and projecting said partially threaded rod through said hole and placing a bolt onto said partially threaded rod to secure said cone holder to said bracket.

9. The method for manufacturing a multi-filament fiber as claimed in claim 8, further comprising:

attaching a second guide to said arm, said second guide having a first guide end, a second guide end and a twisted configuration forming a loop about said second end, said first guide end being attached to said arm.

10. An apparatus for manufacturing a multi-filament gas adsorption fiber in a single step, comprising:

means for supplying a first yarn;

means for supplying a second yarn;

means for guiding the first and second yarns into being substantially parallel with respect to each other;

means for supplying a third yarn; and means for combining and twisting the parallel disposed first and second yarns with the third yarn.

* * * * *

UNITED STATES PATENT AND TRADEMARK OFFICE

CERTIFICATE OF CORRECTION

PATENT NO. : 6,513,314 B2
DATED : February 4, 2003
INVENTOR(S) : Ricky A. Cook

It is certified that error appears in the above-identified patent and that said Letters Patent is hereby corrected as shown below:

Column 1,
Lines 29, 36, 38 and 43, “yam” should be -- yarn --.

Signed and Sealed this

Eighth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,513,314 B2 
DATED : February 4, 2003
INVENTOR(S) : Ricky A. Cook and Antonius Hoogwijk It is certified that error appears in the above-identified patent and that said Letters Patent is hereby corrected as shown below:

Title page,
Item [75], Inventor should read
-- [75] Inventors: Ricky A. Cook, Scottsboro, AL (US);
Johannes Antonius Hoogwijk, Arnhem (NL) --

Signed and Sealed this

Ninth Day of March, 2004

JON W. DUDAS
*Acting Director of the United States Patent and Trademark Office*